US007576534B2

(12) United States Patent
Audet et al.

(10) Patent No.: US 7,576,534 B2
(45) Date of Patent: Aug. 18, 2009

(54) SYSTEM AND METHOD TO FORECAST THE ELECTRICAL CONDUCTIVITY OF ANODES FOR ALUMINUM PRODUCTION BEFORE BAKING

(75) Inventors: Daniel Audet, Chicoutimi (CA); Luc Parent, Chicoutimi (CA)

(73) Assignee: Universite Du Quebec A Chicoutimi, Chicoutimi (Quebec) (CA)

( * ) Notice: Subject to any disclaimer, the term of this patent is extended or adjusted under 35 U.S.C. 154(b) by 406 days.

(21) Appl. No.: 10/582,191

(22) PCT Filed: Dec. 10, 2004

(86) PCT No.: PCT/CA2004/002106

§ 371 (c)(1),
(2), (4) Date: Jun. 9, 2006

(87) PCT Pub. No.: WO2005/057227

PCT Pub. Date: Jun. 23, 2005

(65) Prior Publication Data

US 2007/0114126 A1 May 24, 2007

Related U.S. Application Data

(60) Provisional application No. 60/528,720, filed on Dec. 12, 2003.

(51) Int. Cl.
*G01N 27/72* (2006.01)

(52) U.S. Cl. ..... 324/234; 324/228; 324/233; 324/236; 324/239; 324/240; 324/241; 324/242; 324/243; 324/259; 324/260; 324/261; 324/263; 324/237; 324/238

(58) Field of Classification Search ..... 324/228, 324/233, 234, 236–243, 259, 260, 261, 263
See application file for complete search history.

(56) References Cited

U.S. PATENT DOCUMENTS

| | | | | |
|---|---|---|---|---|
| 2,102,450 | A | 12/1937 | Zuschlag | |
| 2,858,505 | A | 10/1958 | Shawhan | |
| 3,273,056 | A | 9/1966 | Flaherty et al. | |
| 3,361,962 | A | 1/1968 | Albrecht | |
| 3,603,873 | A | 9/1971 | Cirulis | |
| 3,611,125 | A | 10/1971 | Sharon et al. | |
| 3,694,740 | A * | 9/1972 | Bergstrand | 324/227 |
| 3,735,253 | A | 5/1973 | Seger | |
| 3,936,734 | A | 2/1976 | Brandli et al. | |
| 4,012,690 | A | 3/1977 | Heytow | |
| 4,756,814 | A | 7/1988 | Van Voren et al. | |
| 4,770,826 | A | 9/1988 | Van Voren | |
| 5,552,704 | A * | 9/1996 | Mallory et al. | 324/233 |
| 6,268,723 | B1 * | 7/2001 | Hash et al. | 324/243 |
| 2003/0221970 | A1 | 12/2003 | De Nora | |

FOREIGN PATENT DOCUMENTS

| | | |
|---|---|---|
| CA | 2004/002106 | 4/2005 |

* cited by examiner

*Primary Examiner*—Bruce F Bell
(74) *Attorney, Agent, or Firm*—Holland & Knight LLP

(57) ABSTRACT

The system (10) and the method are used for forecasting the electrical conductivity of an anode (12) for aluminum production before the anode (12) is baked. In the system (10), at least one receiving coil (20,22) is coupled to an electromagnetic field emitting unit (14,18). A sensing device (30) is connected to the receiving coil (20,22), the sensing device (30) outputting a signal indicative of a variation of the electromagnetic field received by the receiving coil (20,22) as the crude anode (12), or a portion thereof, passes inside the receiving coil (20,22). A value indicative of the electrical conductivity of the anode (12) is then calculated using the signal from the sensing device (30) and signals previously obtained using reference anodes (12). This way, the electrical conductivity of the anodes (12) can be forecasted before the crude anodes (12) are baked.

8 Claims, 3 Drawing Sheets

SYSTEM AND METHOD TO FORECAST THE ELECTRICAL CONDUCTIVITY OF ANODES FOR ALUMINUM PRODUCTION BEFORE BAKING

CROSS-REFERENCE TO RELATED APPLICATIONS

This application claims priority under 35USC§119(e) of U.S. provisional patent application 60/528,720, filed Dec. 12, 2003, entitled "System and Method to Forecast the Electrical Conductivity of Anodes for Aluminum Production Before Baking", which is hereby incorporated by reference.

BACKGROUND

The Hall-Heroult process is a well-know method used for mass-producing aluminum (which metal is also sometimes referred to as "aluminium"). This process uses electrolytic cells in which purified alumina is dissolved into a mixture having a large content of molten cryolite. The electrodes used in a Hall-Heroult cell are generally made of a carbonaceous material having a good electrical conductivity. The cathode is a permanent electrode that can last many years and at least one is placed at the bottom of a cell. Each cell generally contains a multitude of anodes placed at the top thereof. Aluminum is produced when a large electric current go through the electrodes. Under the influence of the current, the oxygen of the alumina is deposited on the anodes and is released as carbon dioxide, while free molten aluminum, which is heavier than the electrolyte, is deposited on the cathode at the bottom of the cell. The anodes are thus not permanent and are consumed according to the aluminum production rate. They must be replaced once they have reached their useful life.

A large part of the world production of aluminum is obtained from Hall-Heroult cells that use pre-baked anodes. Pre-baked anodes are consumed in about 10 to 45 days. A typical large Hall-Heroult cell can contain more than twenty anodes. Since an aluminum smelter can have many hundreds of cells in a single plant, it is therefore necessary to produce and replace each day several hundreds of anodes. Having an adequate supply of good anodes is a major concern for aluminum smelters.

Anodes are usually made from two basic materials, namely petroleum coke and pitch. Coke is a solid material that must be heated at a high temperature before use. Pitch is a viscous and sticky material that binds solid particles of coke together and increases the surface of contact between particles. Having a larger surface of contact between particles increases the electrical conductivity of the anodes. However, adding a too high proportion of pitch usually creates porosities that decrease the electrical conductivity of the anodes. There is thus an optimum proportion of pitch in the composition of the crude anodes. Typically, the mixture contains between 10 and 20% by weight of pitch, which generally yields a product having a good cohesion and an adequate electrical conductivity.

Optimizing the electrical conductivity of anodes is relatively important in terms of operation costs. When the current flows through the anodes, a part of the energy is transformed into heat. This energy is wasted and must be minimized to improve the efficiency of the process and the aluminum production rate. Therefore, anodes must ideally have the highest possible electrical conductivity.

The percentage of pitch is generally adjusted according to the size distribution of coke particles. Higher content of pitch is necessary to bind particle of smaller diameter. When the target composition of the mixture is obtained, a pre-defined amount is pressed and possibly vibrated into a mold having the form of the anode. The resulting product coming out of the mold is a crude anode block weighing between 500 to 1500 kg. Then, the crude anode must be baked, typically for 10 to 15 days, to decompose the pitch into carbon so as to create a permanent binding between coke particles. The baking of anodes is usually done in pits in which a large number of anodes is set. It only after the baking that the electrical conductivity of the anodes can be measured using conventional measuring devices. Before baking, any measurements using these conventional devices are generally unreliable. The electrical conductivity of baked anodes can also be measured when they are in operation in a cell.

As can be seen, any unintentional variation occurring during the manufacturing process of the anodes may go undetected until the baking of these anodes is completed, thus many days after their manufacturing process started. Many factors can affect the electrical conductivity of anodes, all of which represent challenges for the manufacturers of anodes. One of these challenges is the variation of the coke particle size. Typically, coke particle size can vary from 100 microns to 5 cm. The size distribution can vary from one batch to another, thereby resulting in anodes of different electrical conductivity unless the pitch proportion is adjusted accordingly. Another challenge is to keep an accurate proportion of ingredients in the mixture, particularly the pitch. Pitch is a highly viscous product difficult to handle so that the exact amount supplied by the pitch distribution apparatus to the initial mixture may vary from one batch to another. There are also other challenges, such as obtaining a very homogenous mixture of the ingredients, preventing air from being entrapped in the mixture and create voids, obtaining an optimal compaction of the mixture in the molds before baking, and preventing elastic deformation of the coke particles in effort to avoid layer separation in the blocks. All these factors may potentially shift the electrical conductivity of one or several anodes out of the target value. As aforesaid, this will only be known once the anodes are baked, thus many days later. At that point, corrections can be made to the manufacturing process but the anodes already manufactured or currently being baked may be defective or otherwise less desirable.

SUMMARY

One aspect of the present invention is to provide a system to forecast the electrical conductivity of an anode for aluminum production before baking, the system being characterized in that it comprises:

an electromagnetic field emitting unit to generate an excitation electromagnetic field;

at least one receiving coil electromagnetically coupled to the electromagnetic field emitting unit;

a sensing device connected to the receiving coil, the sensing device outputting a signal indicative of a variation of the electromagnetic field received by the receiving coil as the crude anode, or a sample thereof, passes inside the receiving coil;

a carriage unit to move the crude anode, or the sample thereof, at least relative to the receiving coil; and means for calculating a value indicative of the electrical conductivity of the anode using at least the signal from the sensing device and signals previously obtained using reference anodes.

Another aspect of the present invention is to provide a method for forecasting the electrical conductivity of a pre-baked anode for aluminum production before the anode is baked, the method being characterized in that it comprises:

generating an excitation electromagnetic field;

moving the anode at a crude stage, or a sample thereof, within at least one receiving coil electromagnetically coupled to the electromagnetic field;

sensing a variation in the electromagnetic field received by the receiving coil and outputting a signal indicative thereof; and calculating a value indicative of the electrical conductivity of the anode using the signal indicative of the variation and previously-recorded signals obtained with reference anodes for which the electrical conductivity has been measured after baking.

Another aspect of the present invention is to provide a method of forecasting the electrical conductivity of a new anode for aluminum production before baking of the anode, the method being characterized in that it comprises:

sensing a variation caused by a first reference crude anode to an excitation electromagnetic field received by at least one receiving coil;

sensing the variation for a plurality of additional reference crude anodes having various compositions;

measuring the electrical conductivity of the reference anodes once baked;

determining a correlation between the sensed variations for the reference anodes before baking and their electrical conductivity measured after baking;

sensing the variation for the new anode at a crude stage; and calculating a value indicative of the electrical conductivity of the new anode using the correlation between the sensed variations for the reference anodes before baking and their measured electrical conductivity after baking.

DESCRIPTION OF THE FIGURES

These and other aspects are described in or apparent from the following detailed description made in conjunction with the accompanying figures, in which.

DETAILED DESCRIPTION

It was found that it is possible to forecast the electrical conductivity of an anode, thus before baking, with an arrangement involving the disruption of a current induced in a receiving coil using the crude anode or a sample thereof. The current is induced using an emitting coil, or any similar arrangement which outputs an excitation electromagnetic field. The induced current is then measured and will provide a value indicative of the electrical conductivity when compared to data obtained using reference anodes.

It should be noted at this point that the term "conductivity" is used in a non-limitative manner. The "conductivity" is somewhat similar to the "resistance". Both terms are interlinked since one is simply the opposite of the other. Therefore, one can forecast the electrical resistance of an anode instead of forecasting the electrical conductivity thereof and achieve the same result. The goal in that context is to minimize the resistance so as to minimize the waste of energy when a current flows through the anode.

Figure 1:
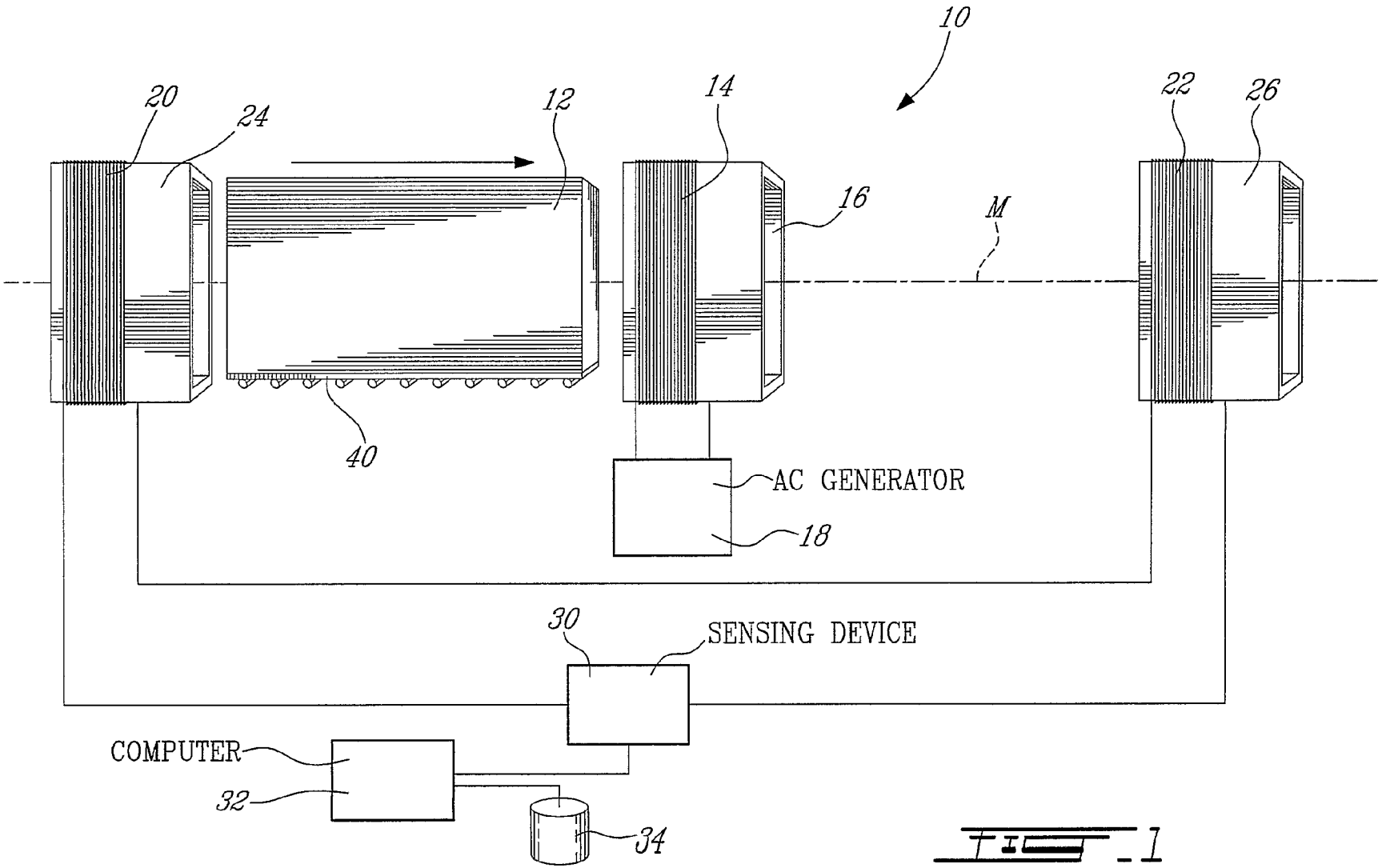
FIG. 1 is a schematic view of an example of a system to forecast the electrical conductivity of an anode.

FIG. 1 is a schematic view showing an example of a system (10) used to forecast the electrical conductivity of an anode (12) before baking. This system (10) includes an emitting coil (14) which is used to generate a time-varying excitation electromagnetic field. The emitting coil (14) is preferably winded around a non-conductive support (16). It is also connected to an AC generator (18) used to generate an AC signal, preferably at a frequency between 100 and 10,000 Hertz. Other frequencies could be used as well.

The illustrated system (10) further comprises two opposite receiving coils (20, 22), each being preferably winded around corresponding supports (24, 26) and positioned at a same distance from the emitting coil (14). Using only one receiving coil is also possible. The use of two opposite receiving coils (20, 22) is nevertheless preferred since this improves the accuracy of the signal, as explained hereafter. The emitting coil (14) is positioned between the two receiving coils (24, 26) and preferably, all coils are substantially aligned with reference to a main axis (M). The receiving coils (24, 26) are positioned so that they will be electromagnetically coupled to the emitting coil (14), considering the strength of the excitation signal. The shape of the various supports (16, 24, 26) can be square, round or any other shape. They can be made of plastics, ceramics or any other material having a low electrical conductivity. Other configurations are also possible, including in the alignment of the coils.

In FIG. 1, one of the receiving coils (20, 22) is winded one direction, the other being winded in the opposite direction. Thus, if one is wound in a clockwise direction, the other is wound in the counterclockwise direction. They are both connected in series and so as to form a closed loop circuit. This double-sided arrangement cancels the natural induction of the emitting coil (14) in the receiving coils (20, 22). Thus, in the absence of the anode (12), the induced current in the circuit will be null, thereby improving the precision of the system (10). The two receiving coils (20, 22) have substantially identical characteristics, such as the number of loops, the size, the spacing with the emitting coil (14). Nevertheless, other arrangements are possible as well.

The system (10) further comprises a sensing device (30) connected to the circuit of the receiving coils (20, 22). This allows obtaining a signal indicative of a variation of the electromagnetic field when an anode (12) is being evaluated. This sensing device (30) may be in the form of a current measuring device, for instance an ammeter. Other devices can be used as well. For instance, one can use a voltmeter connected to the terminals of a resistor (not shown). The sensing device (30) is linked to a computer (32) for recording the signal and for further processing. The various calculations and analysis can be done in this computer (32) and the data are recorded in a memory, for instance on a disk (34).

As aforesaid, both coils (20, 22) are positioned at a substantially equal distance from the emitting coil (14). This distance is preferably at least the length of the anode (12) or the samples thereof. This yields a better signal.

The system (10) can be sized either to receive the whole anodes (12) or only a sample thereof. This determines the size of the various coils. The samples are small portions of the anodes (12) taken at one or more locations, for example using core drilling. Using samples yields a substantial reduction in the size of the system (10). A small system (10) is easier to shield from parasitic electromagnetic signals. On the other hand, using a full-scale system (10) provides on-line evaluation of the crude anodes (12) and is non-invasive. The whole anode (12) can be evaluated, which is useful for detecting problems in a part of an anode (12) that would not be sampled.

In use, the anode (12), or a sample thereof, is passed into the first receiving coil (20), preferably at a constant speed. A carriage unit (40), such as a conveyor belt or a cart, moves the anode (12) or its sample. Alternatively, one can use coils movable relative to a non-moving anode (12). The electromagnetic field emanating from the emitting coil (14) is then received by the anode (12) and this disrupts the electromagnetic field around one of the receiving coils (20, 22). The induced current in the circuit will no longer be zero and this can be measured using the sensing device (30), preferably in function of time. The anode (12) travels all the way through the first receiving coil (20) and preferably continues through the emitting coil (14) and through the second receiving coil (22). It then exits the system (10), although it can be sent backward through the system (10) for another evaluation or for any other reason, such as the design of the production line.

Figure 2:
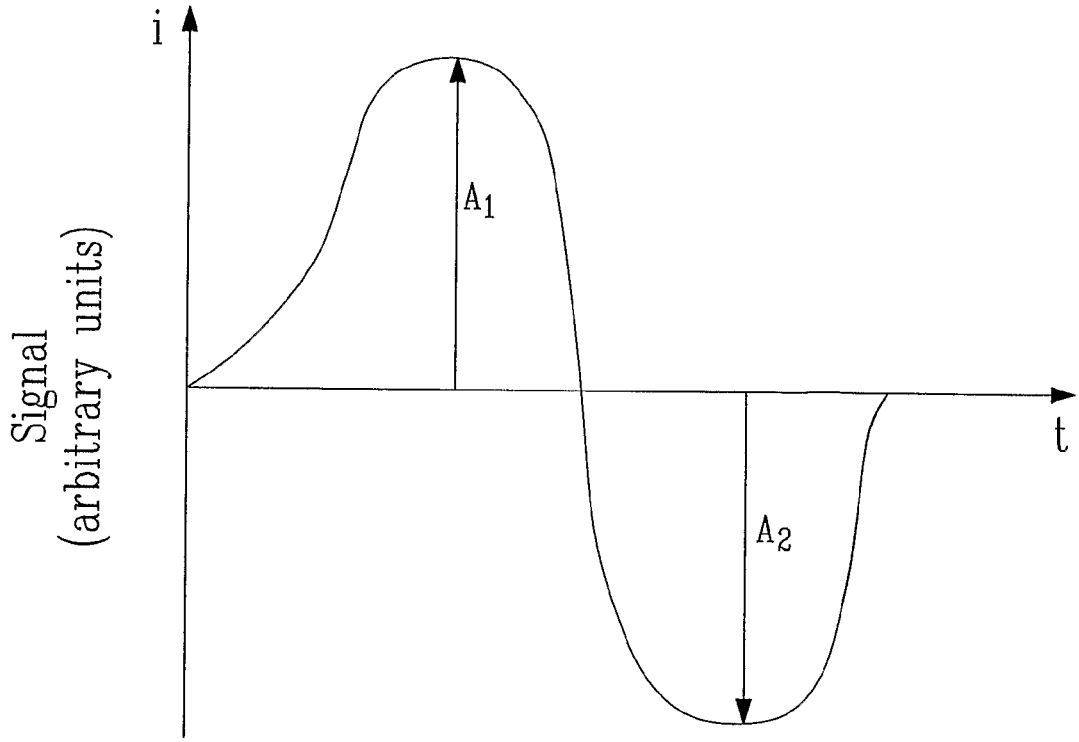
FIG. 2 is a graph schematically depicting an example of a possible signal sensed by the sensing device in function of time.

FIG. 2 shows a typical aspect of the signal. This signal has a positive portion and a negative portion. This is indicative of the fact that the anode (12), or the sample, went all the way through both receiving coils (20, 22) and that the second winding is winded in the opposite direction. One of the most significant parts of the signal is the amplitude of each portion. It was found that anodes of different conductivities will have different signal amplitudes. The maximum signal amplitude $A_1$ in the first portion will generally be identical to the maximum signal amplitude $A_2$ in the second portion if the receiving coils (20, 22) have substantially identical characteristics. Both amplitudes ($A_1$, $A_2$) can be averaged or added before further processing. Yet, the shape of the signal or other parameters thereof could be used to further predict the electrical conductivity or other aspects concerning the quality of the anodes.

Figure 3:
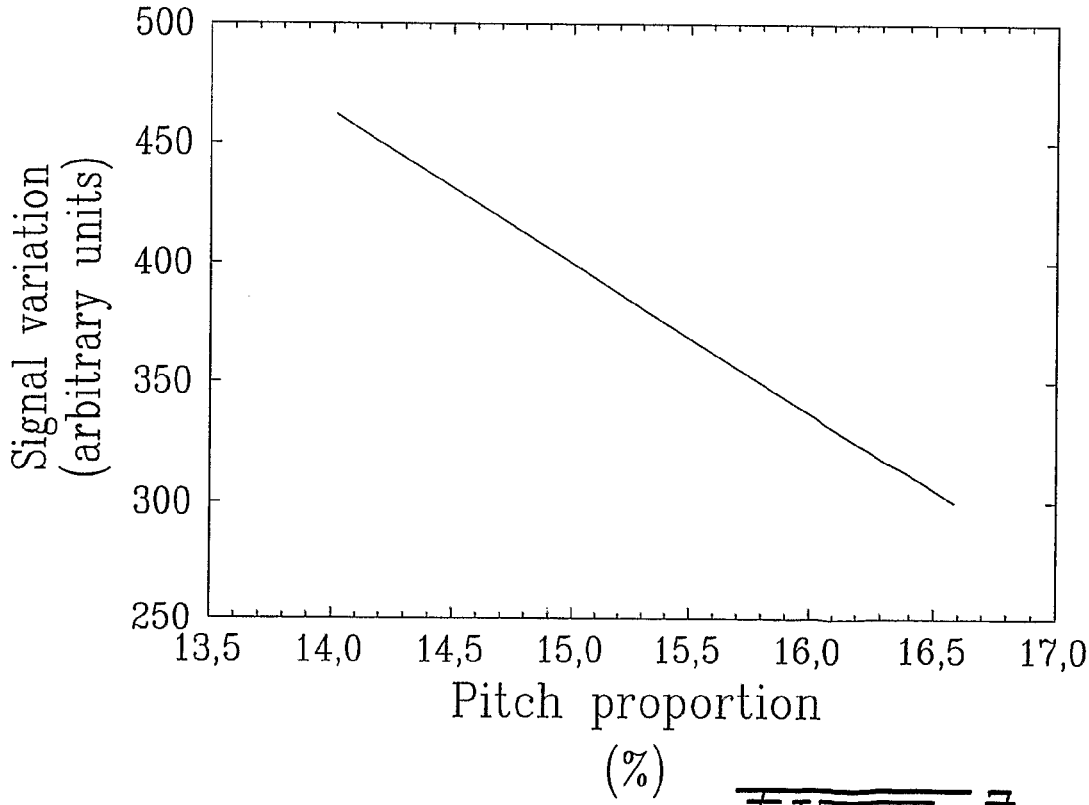
FIG. 3 is a graph depicting an example of a possible relationship between the maximum variation in the signal at the receiving coils and the pitch proportion of crude anodes, obtained from a number of reference anodes.
Figure 4:
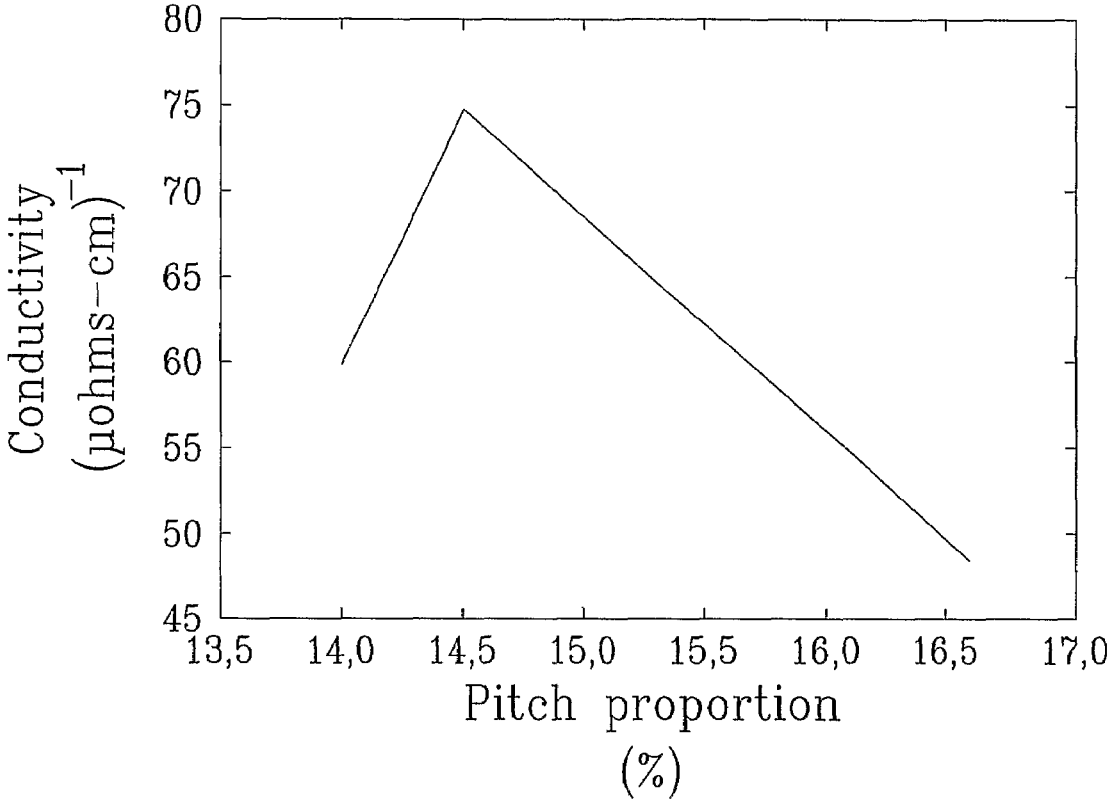
FIG. 4 is a graph depicting an example of a possible relationship between the electrical conductivity measured on reference anodes after baking, in function of the pitch proportion.
Figure 5:
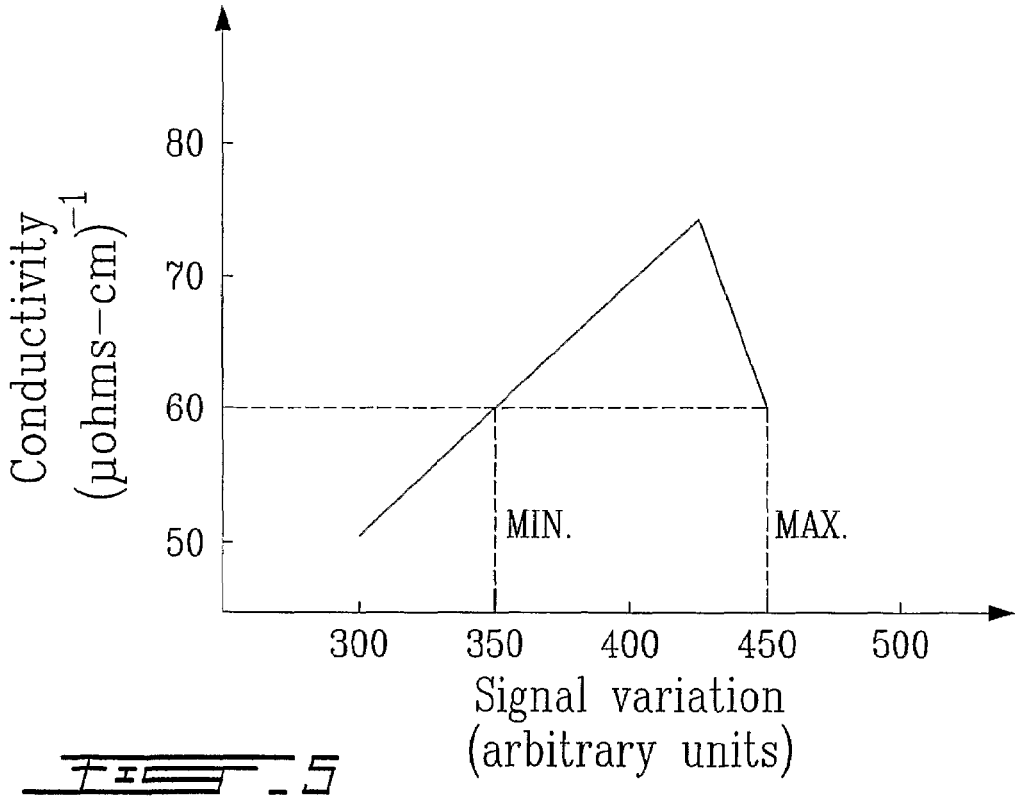
FIG. 5 is a graph depicting an example of a possible overall relationship between the electrical conductivity and the signal at the receiving coils.

FIG. 3 is a graph showing an example using the maximum amplitudes of reference anodes having various pitch proportions. The maximum amplitudes are in arbitrary units and are obtained from a number of reference anodes or samples thereof. These data will be used to calibrate the system. Once the measurements of the signals are made, the reference anodes are baked. Then, once the baking of the reference anodes is over, their electrical conductivity is directly measured using conventional methods or by monitoring their efficiency while in use. This can be plotted in a graph, such as the example shown in FIG. 4. FIG. 5 is an example of such graph. Moreover, additional reference data can be obtained by varying other parameters of the manufacturing process. This can perfect the model and ultimately increase the precision of the forecast.

FIG. 5 further shows that it is possible to use the forecast of the electrical conductivity of the anodes so as to correct the proportions of the crude anodes to manufacture. The illustrated example shows that the optimal electrical conductivity is obtained with a signal amplitude of about 430 units. Hence, it is possible to forecast the electrical conductivity of the anodes using the combined data from the two graphs. This way, one can even obtain an optimal electrical conductivity of anodes through a feedback system. One can also use a threshold value for the electrical conductivity of anodes. For instance, a smelter may determine that an anode below an electrical conductivity of 60 $\mu$ohms-cm$^{-1}$ is not suitable. Therefore, this smelter or its anode manufacturer can discard, before baking, any anodes expected to be below the threshold. In the example of FIG. 5, a suitable anode would have a signal variation between 350 and 450 arbitrary units. Any anode outside this range could be discarded.

As can be appreciated, the system and method as described herein provide a very suitable way of forecasting the electrical conductivity of anodes before baking.

What is claimed is:

1. A method for forecasting the electrical conductivity of an anode for aluminum production, the method comprising:

generating an excitation electromagnetic field;

moving the anode, or a sample thereof, within at least one receiving coil electromagnetically coupled to the electromagnetic field before baking of the anode;

sensing a variation in the electromagnetic field received by the at least one receiving coil and outputting a signal indicative thereof;

calculating a value indicative of the electrical conductivity of the anode; wherein the value indicative of the electrical conductivity of the anode is calculated using the signal indicative of the variation in the electromagnetic field received by the at least one receiving coil and previously-recorded signals obtained with reference anodes before baking thereof and for which the electrical conductivity has also been directly measured after baking using conventional methods or by monitoring their efficiency during use; and the calculated value being indicative of the electrical conductivity of the anode after baking, comparing the value indicative of the electrical conductivity of the anode to a threshold value; and discarding the anode before baking based on the fact that its forecasted electrical conductivity is below the threshold value.

2. The method as defined in claim 1, further comprising the step of:

modifying composition of subsequently-manufactured crude anodes based on the forecasted electrical conductivity of the anode so as to optimize the electrical conductivity of the subsequently-manufactured anodes after baking.

3. The method as defined in claim 1, wherein the value indicative of the electrical conductivity of the anode is calculated using a value indicative of a maximum variation in the signal.

4. A method of forecasting the electrical conductivity of an anode for aluminum production before baking thereof, the method comprising the steps of:

sensing a variation caused by a first reference crude anode to an excitation electromagnetic field received by at least one receiving coil;

sensing the variation for a plurality of other reference crude anodes having various compositions;

measuring the electrical conductivity of the reference anodes after baking thereof using conventional methods or by monitoring their efficiency during use;

determining a correlation between the sensed variations for the reference anodes before baking and their electrical conductivity measured after baking;

sensing the variation for an additional anode before baking thereof;

calculating a value indicative of the electrical conductivity of the additional anode using the correlation between the sensed variations for the reference anodes before baking and their measured electrical conductivity after baking;

5. The method as defined in claim 4, further comprising the steps of:

comparing the forecasted electrical conductivity of the additional anode to a threshold value; and discarding the additional anode before baking based on the fact that its forecasted electrical conductivity is below the threshold value.

6. The method as defined in claim 4, further comprising the step of:

modifying the composition of subsequently-manufactured additional crude anodes based on the forecasted electrical conductivity of the additional anode in effort to meet the electrical conductivity threshold.

7. The method as defined in claim 4, wherein the value indicative of the electrical conductivity of the additional anode is calculated using a value indicative a maximum variation in the signal.

8. A method of forecasting the electrical conductivity of an anode for aluminum production before baking thereof, the method comprising the steps of:

sensing a variation caused by a first reference crude anode to an excitation electromagnetic field received by at least one receiving coil;

sensing the variation for a plurality of other reference crude anodes having various compositions;

measuring the electrical conductivity of the reference anodes after baking thereof;

determining a correlation between the sensed variations for the reference anodes before baking and their electrical conductivity measured after baking;

sensing the variation for an additional anode before baking thereof; and calculating a value indicative of the electrical conductivity of the additional anode using the correlation between the sensed variations for the reference anodes before baking and their measured electrical conductivity after baking, and using a value indicative a maximum variation in the signal.

* * * * *

UNITED STATES PATENT AND TRADEMARK OFFICE

CERTIFICATE OF CORRECTION

PATENT NO. : 7,576,534 B2
APPLICATION NO. : 10/582191
DATED : August 18, 2009
INVENTOR(S) : Audet et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 476 days.

Signed and Sealed this

Seventh Day of September, 2010

David J. Kappos

David J. Kappos
*Director of the United States Patent and Trademark Office*